United States Patent [19]

Santangelo

[11] Patent Number: 4,899,635

[45] Date of Patent: Feb. 13, 1990

[54] DRUM MUTE

[76] Inventor: Ron L. Santangelo, 531 Amerige #A, Fullerton, Calif. 92632

[21] Appl. No.: 377,562

[22] Filed: Jul. 10, 1989

[51] Int. Cl.[4] ..... G10D 13/02

[52] U.S. Cl. ..... 84/411 M

[58] Field of Search ..... 84/411–420

[56] References Cited

U.S. PATENT DOCUMENTS 4,244,266 1/1981 Hardy ..... 84/411 M 4,325,280 4/1982 Hardy ..... 84/411 M 4,567,807 2/1986 Robinson ..... 84/411 M

*Primary Examiner*—Lawrence R. Franklin

*Attorney, Agent, or Firm*—Edgar W. Averill, Jr.

[57] ABSTRACT

A drum mute for eliminating overtones and ringing that occurs when a drum head to which the mute is affixed is struck. The drum mute has a thin, flexible, resilient sheet which may be adhered to the drum head. The undersurface of the sheet includes an adhesive to adhere it to the drum head and an area of felt. Preferably, the sheet has an angled bend to resiliently hold the felt against the drum head.

16 Claims, 1 Drawing Sheet

10
11
12
13
14
15
16
17

14
15
17

17
18
19
20
21
24
25
29
30

14
17
18
19
20
21
24
25
28
30

17
18
19
20
21
24
25
27
30

33
34
35
36

17
18
20
21
22
23
24
25
30
32

14
33
34
35
36

DRUM MUTE

BACKGROUND OF THE INVENTION

The field of the invention is accessories for musical instruments, and the invention relates more particularly to percussion instruments such as drums and mutes associated therewith.

Drums often create, in addition to their desired sound, an overtone and ringing when hit. Various mutes have been devised in an effort to reduce or eliminate such undesired overtones. One such mute is shown in the Saputo U.S. Pat. No. 4,671,158. This device is affixed to the rim of the drum and is limited in placement in that it is required to be adjacent the counterhoop of the drum. Furthermore, it, being composed of arms and screws, can loosen upon use. Still further, the pressure exerted upon the drum head must be adjusted. The mute shown in the Robinson U.S. Pat. No. 4,567,807 is affixed to the rim of a drum. It also is thus limited in placement to a position adjacent the rim. The muting effect is brought about by gravity. It is, thus, limited in response time as well as limited for use where the drum head is generally horizontal. Various other mutes are shown in U.S. Pat. Nos. 4,244,266, 4,325,280, 4,246,825, 573,320 and 663,853. None of these devices permit a combination of a positive force of the mute against the drum head and a completely randoming positioning of the mute combined with inexpensive construction.

SUMMARY OF THE INVENTION

It is an object of the present invention to provide an easily installed drum mute which provides a positive muting pressure against the drum head and which may be used in any drum head orientation.

The present invention is for a drum mute for eliminating overtones and ringing that occur when a drum head to which the mute is affixed is struck. The mute comprises a flexible, resilient sheet having an outer surface, an inner surface and a peripheral edge. A layer of delayed tack adhesive is affixed to at least a portion of the inner surface of the sheet. Another portion of the sheet contains an area of felt, and when the sheet is adhered to a drum head, the felt is held against the outer surface of the drum head. When the drum head is struck, the desired drum sound is emitted, but the mute quickly touches the head before undesirable overtones are created. Preferably, the flexible, resilient sheet has an angled bend to further urge the felt against the drum head. Because the mute is held on by adhesive directly to the drum head, it may be placed in any position on the drum head to provide an optimum amount of muting. Furthermore, more than one mute may be adhered to the drum head.

DESCRIPTION OF THE PREFERRED EMBODIMENTS

Figure 1:
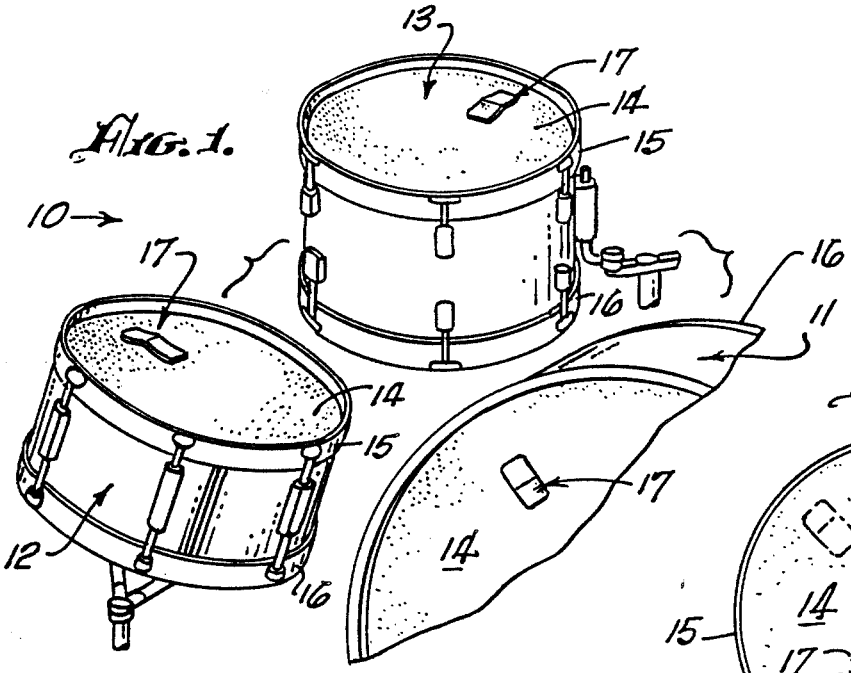
FIG. 1 is a perspective view of a plurality of drums having a mute of the present invention adhered to the head thereof.

A set of drums is shown in perspective view in FIG. 1 and indicated generally by reference character 10. The set of drums includes a bass drum 11, a snare drum 12 and a tom drum 13. Each drum has a drum head or skin 14 and a pair of counterhoops 15 and 16.

Figure 3:
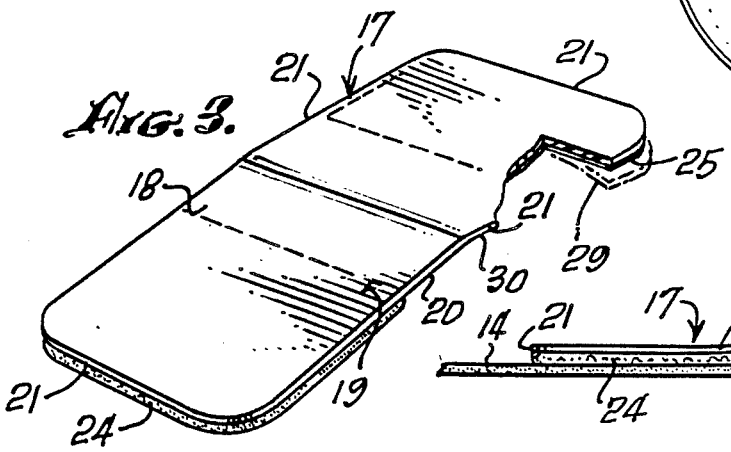
FIG. 3 is a perspective view partially cut away of the drum mute of the present invention.
Figure 6:
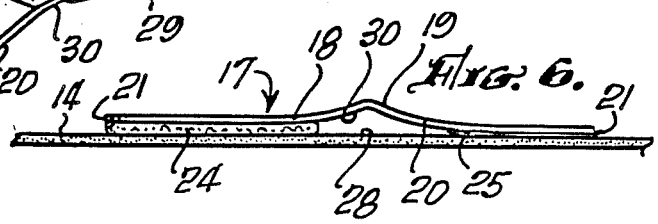
FIG. 6 is side view of the drum mute of the present invention adhered to the head of a drum.
Figure 4:
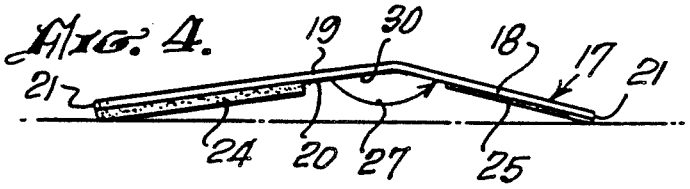
FIG. 4 is a side view of the drum mute of FIG. 3.
Figure 5:
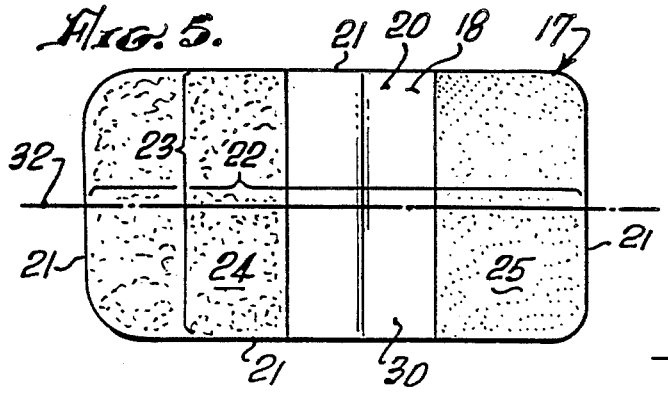
FIG. 5 is a bottom view thereof.

The drum mute of the present invention is indicated by reference character 17 and is shown best in FIG. 3. Drum mute 17 is made from a flexible, resilient sheet 18. A sheet of 15 mil polyvinyl chloride has been found useful, although other thin, flexible and resilient materials could be used. Sheet 18 has an outer surface 19, an inner surface 20 and a peripheral edge 21. It is generally in the form of an elongated rectangle whose length 22 is approximately twice its width 23. An area of felt 24 is adhered to a portion of inner surface 20. A layer of delayed tack adhesive 25 is also adhered to inner surface 20. Preferably, an angled bend 26 (shown best in FIG. 4) is formed across sheet 18. Angled bend should be an obtuse angle indicated by reference character 27, in FIG. 4, and ideally it is between 160° and 170° degrees. The longitudinal axis 32 is shown in FIG. 5, and it is preferable that angled bend 26 be at right angles thereto. As shown best in FIG. 6, when adhesive 25 has been adhered to drum head 14, the area of felt 24 is elastically urged against the upper surface 28 of drum head 14. Preferably, a peel-off cover 29 is provided for removal prior to adhering to drum head 14. It is also preferable that there be an adhesive-free area 30 between adhesive 25 and felt 24. This provides an area of flexure which permits the felt to rise off the upper surface 28 of the drum head at the instant the drum head is struck while still urging the felt elastically downward toward the drum head to quickly mute out overtones. It is also preferable that the mute have rounded corners 31.

The term "felt" is not intended in its narrow sense but rather in its functional sense. That is, any soft, muffling type of composition would be likely to be useful. A felt having a thickness of about one-sixteenth of an inch has been found useful.

A mute having a length 22 of $3\frac{1}{4}$ inches, a width 23 of $1\frac{3}{4}$ inches was fabricated. An area of felt extending 2 inches from one longitudinal end to the angled bend was adhered to the inner surface 20. At the other end of the inner surface, the length of double-faced adhesive tape was adhered to the inner surface from the edge a distance of $\frac{5}{8}$ of an inch. This left a length of $\frac{5}{8}$ of an inch along the longitudinal axis 32 of an adhesive-free and felt-free area which permits the flexing of the mute during use.

Figure 7:
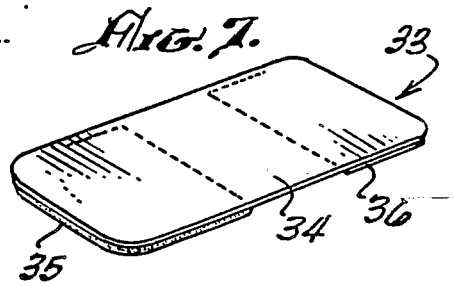
FIG. 7 is an alternate embodiment of the drum mute of the present invention.
Figure 8:
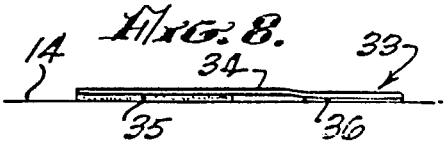
FIG. 8 is a side view of the alternate embodiment of FIG. 7 adhered to a drum head.

Although angled bend 26 is preferred, the device can also be fabricated without an angled bend. Such a mute 33 is shown in FIG. 7, and this also is fabricated from a resilient sheet 34 and includes an area of felt 35 and an area of delayed tack adhesive 36. This is shown applied to the upper surface 28 of a drum head 14 in FIG. 8. It can be seen that the adhesive layer 36 is thinner than the felt layer 35 and, thus, elastically holds the felt layer 35 against the upper surface 28 of drum head 14.

Figure 2:
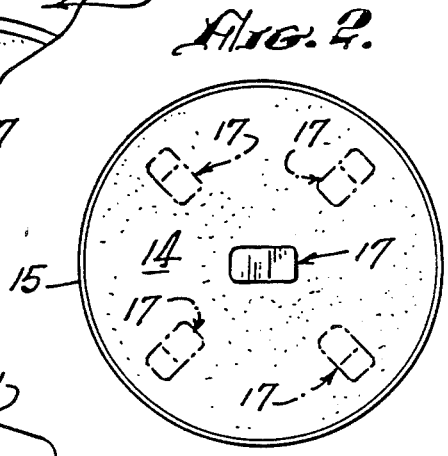
FIG. 2 is a plan view of one of the drums of FIG. 1 showing the drum mute of the present invention together with a phantom view of possible drum mute placement locations.

As indicated in FIG. 2, the mute can be placed at any area of the drum head 14. Furthermore, more than one mute can be placed on a single drum head if desired. It is also evident that the drum mute of the present invention may be inexpensively fabricated and is very portable. It may be placed on the drum head so that it is completely free of any interference with the playing of the drum and is easily removed if desired. The mute of the present invention is not limited to one specific size of drum, and one size of mute fits all sizes and styles of drums. Furthermore, the device is not limited to use on drums which have a rim, and rimless drums, such as conga drums and concert timpani drums can also readily use the drum mute of the present invention. Furthermore, because the device works by resiliency, it may operate in any given attitude, that is, upside down or vertical. Thus, the device can be used both on the top and the bottom of the same drum if desired.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A drum mute for eliminating overtones and ringing that occurs when a drum head to which the mute is affixed is struck, said drum mute comprising:

a flexible, resilient sheet having an outer surface, an inner surface and a peripheral edge;

a layer of delayed tack adhesive affixed to at least a portion of said inner surface of said sheet;

an area of felt affixed to only a portion of said inner surface and positioned so that the inner surface has a portion of said layer of delayed tack adhesive exposed and an area of felt exposed whereby when the layer of delayed tack adhesive is placed into contact with a drum head, the area of felt abuts the drum head thereby muting overtones.

2. The drum mute of claim 1 wherein said flexible, resilient sheet has an angled bend therein forming an obtuse angle on the inner surface, said obtuse angle separating the inner surface into two areas namely an adhesive area and a felt area, and said layer of delayed tack adhesive is affixed to at least a portion of said adhesive area, and said area of felt is affixed to at least a portion of said felt area.

3. The drum mute of claim 2 wherein said obtuse angle is between 160° and 170°.

4. The drum mute of claim 2 wherein said adhesive area has an adhesive-covered portion and an adhesive-free area and said adhesive-free area is adjacent said angled bend.

5. The drum mute of claim 4 wherein said sheet is generally rectangular with rounded corners.

6. The drum mute of claim 2 wherein said felt area is completely covered with a layer of felt.

7. A drum mute affixed to the head of a drum, said drum mute comprising:

a generally rectangular, thin sheet fabricated from a resilient material, said thin sheet having an inner surface, an outer surface and an outer periphery, said inner surface including an area of adhesive adhering said sheet to a surface of said head and said inner surface further having a layer of felt affixed to a different area than said adhesive area, whereby the sound caused by the striking of said head is muted by contact with said layer of felt.

8. The drum mute affixed to the head of a drum of claim 7 wherein said generally rectangular, thin sheet is an elongated rectangle having a longitudinal axis and is divided by a bend forming an obtuse angle in the inner surface thereof and said bend being at about a right angle with respect to said longitudinal axis of said sheet, and said area of adhesive is on one side of said angled bend, and said layer of felt is on the other side of said angled bend.

9. The drum mute affixed to the head of a drum of claim 8 wherein said obtuse angle is between about 160° and 170°.

10. The drum mute affixed to the head of a drum of claim 8 wherein said area of adhesive is spaced from said angled bend so that there is an adhesive-free area adjacent said angled bend.

11. The drum mute affixed to the head of a drum of claim 10 wherein said layer of felt completely covers the inner surface of that portion of said inner surface between the angled bend and the outer periphery of said sheet.

12. The drum mute affixed to the head of a drum of claim 11 wherein said adhesive area covers about one half of that portion of the inner side between the angled bend and the outer periphery of said sheet.

13. The drum mute affixed to the head of a drum of claim 8 wherein said sheet is fabricated from polyvinyl chloride having a thickness of about 15 mil.

14. The drum mute affixed to the head of a drum of claim 7 wherein said drum includes a counterhoop, and said drum mute is affixed at a spot separated a distance from said counterhoop.

15. A drum mute fabricated from a thin, elongated rectangular sheet having an outer periphery including rounded corners, said sheet having an outer surface and an inner surface and having a longitudinal axis, said sheet further having an angled bend formed so that it is at a right angle with respect to its longitudinal axis and the angle of said angled bend being an obtuse angle with respect to the inner surface of said sheet and said angled bend dividing the inner surface into a felt area and an adhesive area and said felt area having a layer of felt held thereto and said adhesive area having a layer of delayed tack adhesive affixed thereto, said layer of adhesive extending from a portion of the outer periphery but said adhesive area being free from adhesive adjacent said angled bend.

16. The drum mute of claim 15 wherein said layer of felt completely covers said felt area.

* * * * *